US009739550B2

(12) United States Patent
Mochak

(10) Patent No.: US 9,739,550 B2
(45) Date of Patent: Aug. 22, 2017

(54) WEAR RESISTANT AMMUNITION FEED RAMP FOR LIGHT-WEIGHT FIREARMS

(71) Applicant: Sturm, Ruger & Company, Inc., Southport, CT (US)

(72) Inventor: Richard Mochak, Russell, MA (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 15/155,601

(22) Filed: May 16, 2016

(65) Prior Publication Data

US 2016/0341504 A1 Nov. 24, 2016

Related U.S. Application Data

(63) Continuation of application No. 62/164,084, filed on May 20, 2015.

(51) Int. Cl.
*F41A 9/24* (2006.01)

(52) U.S. Cl.
CPC ..... *F41A 9/24* (2013.01)

(58) Field of Classification Search
CPC ..... F41A 9/00; F41A 9/24
USPC ..... 42/6
See application file for complete search history.

(56) References Cited

U.S. PATENT DOCUMENTS 1,989,695 A 2/1935 Jensen
2,655,837 A * 10/1953 Johnson ..... F41A 9/29 42/25
3,177,603 A 4/1965 Gillespie
3,584,533 A * 6/1971 Allyn ..... F41A 3/54 42/25
4,335,643 A * 6/1982 Gal ..... F41A 3/54 42/25
5,379,505 A 1/1995 Reed
5,765,302 A 6/1998 Brandl et al.
5,983,773 A 11/1999 Dionne
6,070,512 A * 6/2000 Rohrbaugh ..... F41A 17/06 42/69.02
6,276,252 B1 8/2001 Dionne
(Continued)

OTHER PUBLICATIONS

Corresponding International Search Report and Written Opinion for PCT/US16/32698 dated Aug. 25, 2016.
(Continued)

*Primary Examiner* — Joshua Freeman
(74) *Attorney, Agent, or Firm* — The Belles Group, P.C.

(57) ABSTRACT

A light-weight firearm and related fabrication method are described for a wear resistant feed ramp for chambering cartridges from an ammunition magazine. In one embodiment, the firearm includes a barrel and a frame defining a magazine well and cartridge feed ramp. A wear insert formed of a different material than the frame is implanted in the feed ramp adjacent to the barrel chamber. The wear insert is then machined in situ to shape forming an obliquely angled wear surface. After machining, both the frame and implanted wear insert undergo a surface hardening process together. The surface hardened wear insert has a greater surface hardness than the surface hardened frame and is better adapted to resist wear after repeated chambering of rounds. In one non-limiting example, the frame may be hard anodized aluminum and the wear insert hard anodized titanium.

23 Claims, 8 Drawing Sheets

(56) References Cited

U.S. PATENT DOCUMENTS

| | | | | |
|---|---|---|---|---|
| 6,435,788 | B2 | 8/2002 | Reed | |
| 6,442,882 | B1 * | 9/2002 | Dionne | F41A 5/04 42/15 |
| 6,725,518 | B2 | 4/2004 | Reed | |
| 6,898,888 | B2 * | 5/2005 | Greenhut | F41A 9/69 42/18 |
| 8,234,807 | B2 | 8/2012 | LaTorre et al. | |
| 8,839,541 | B1 | 9/2014 | Karfiol et al. | |
| 9,347,719 | B1 * | 5/2016 | Stone | F41A 9/41 |
| 9,562,730 | B2 * | 2/2017 | Stone | F41A 9/41 |
| 2004/0200110 | A1 * | 10/2004 | Greenhut | F41A 9/69 42/18 |
| 2010/0269390 | A1 | 10/2010 | LaTorre et al. | |
| 2012/0073179 | A1 | 3/2012 | Young | |
| 2013/0061501 | A1 | 3/2013 | Pflaumer et al. | |
| 2013/0145669 | A1 | 6/2013 | Zonshine | |
| 2014/0165440 | A1 | 6/2014 | Mayerl | |
| 2014/0237878 | A1 | 8/2014 | Lambert | |
| 2015/0330730 | A1 * | 11/2015 | Stone | F41A 9/41 89/33.01 |
| 2016/0138880 | A1 * | 5/2016 | Stone | F41A 9/41 89/33.1 |

OTHER PUBLICATIONS

Kobra Carry Lightweight 1911 Handgun, http://www.edbrown.com/kobracarrylw.htm, Searched for on Dec. 1, 2014.

Kobra Carry Lightweight, Ed Brown Products, www.edbrown.com.

Repeiring an aluminum frame feed ramp . . . pcs—1911 Forum, http://forums.1911forum.com/howthread.php?t-146569&highlight-ramp+insert, search for on Dec. 15, 2014.

Evolution Gun Works Inc., http://www.egwguns.com/index.php?p=product&id=1023, searched for on May 11, 2016.

* cited by examiner

WEAR RESISTANT AMMUNITION FEED RAMP FOR LIGHT-WEIGHT FIREARMS

CROSS-REFERENCE TO RELATED APPLICATIONS

The present application claims the benefit of priority to U.S. Provisional Application No. 62/164,084 filed May 20, 2015, which is incorporated herein by reference in its entirety.

BACKGROUND

The present invention generally relates to firearms, and more particularly to a wear resistant ammunition feed ramp and related method for producing the same.

The ammunition feed ramp of a firearm is generally an angled structure configured to smoothly guide the front bullet or slug end of a cartridge fed from a spring-loaded magazine into the chamber formed at the breech end of the barrel. Removable magazines are typically attached to the bottom of the firearm below the breech area and carry multiple cartridges which are automatically dispensed upward into the action by a spring-biased follower each time the action of the firearm is cycled (i.e. breech opened/closed). The cartridge feed cycle occurs rapidly, and as can be expected the feed ramp is highly prone to wear over time.

In some semi-automatic pistols, the feed ramp may be formed as an integral downwardly extending appendage of the barrel. In other semi-automatic pistols such as those modeled after the classic 1911 service pistols, the feed ramp is formed by an integral and unitary structural portion of the frame immediately rearward of the breech end of the barrel. Some 1911 pistols have steel frames with integral feed ramps which offer a fair degree of wear resistance. However, these pistols tend to be heavy and cumbersome to use. To compensate, other 1911 pistols are made with lighter-weight aluminum frames. Although these pistols are easier to handle, feed ramps formed as an integral part of the softer aluminum frame are more susceptible to the wear caused by repeated chambering of cartridges automatically dispensed from the magazine when the firearm's action is cycled. This causes cartridge mis-feeds and jams, reducing the longevity of the firearm.

An improved light-weight pistol is desired having a more durable ammunition feed ramp construction.

SUMMARY

Exemplary embodiments of the present invention provide a wear resistant ammunition feed ramp for light-weight frame firearms and method for producing the same. In one non-limiting embodiment, the feed ramp may be comprised of a light-weight surface hardened wear insert having a density greater than the frame but preferably less than steel. The wear insert may be mounted on the feed ramp and machined in an OEM's (original equipment manufacturer's) factory during the initial firearm fabrication process. The wear insert is both machined to shape and then subsequently surface hardened in situ together with the entire light-weight firearm frame in a single process step. Advantageously, machining after assembly also reduces part tolerance stack up to provide consistent feeding of the round in contrast with installing an already machined wear insert. In addition, surface hardening the frame and insert together eliminates additional process steps and is more cost effective. The wear insert and frame may be hard anodized in one non-limiting surface hardening or coating process. This process produces a hard surface coat or film of suitable depth or thickness having greater wear resistance and life than the underlying softer interior metal core of either the insert or frame.

In one construction, neither the wear insert or frame are made of steel. In one non-limiting embodiment, the wear insert is made of titanium and the frame is made of aluminum resulting in a light-weight structure having feed ramp wear characteristics and life greater than aluminum. In one non-limiting embodiment, the firearm may be a pistol such as a 1911 model type pistol. However, the invention is expressly not limited in its use or application to any particular type of handgun or long gun.

According to one aspect, a light-weight firearm with wear resistant cartridge feed ramp includes: a metallic frame defining a magazine well for insertably receiving an ammunition magazine; a barrel supported by the frame, the barrel including a longitudinally extending bore defining a longitudinal axis, a front muzzle end, and a rear breech end defining a rearwardly open chamber configured for holding a cartridge; an obliquely angled cartridge feed ramp formed by an integral unitary portion of the frame, the feed ramp disposed at an upper end of the magazine well near the rear breech end of the barrel and made of a same material as the frame; and a surface hardened wear insert affixed to the feed ramp adjacent to the chamber in the rear breech end of the barrel, the wear insert arranged to engage a cartridge being loaded into the chamber from the magazine; wherein the wear insert is formed of a different material than the feed ramp. In one embodiment, the wear insert includes an obliquely angled wear surface having a greater hardness than a surface of feed ramp of the frame. The wear insert may be formed of a material having a density greater than the frame but less than the density of steel.

According to another aspect, a light-weight frame with wear resistant cartridge feed assembly for a firearm includes: a longitudinal axis; a metallic body having an unitary monolithic structure formed of a first material and a hard anodized surface; a downwardly open magazine well configured for removably receiving an ammunition magazine; a breech area defined at a top of the magazine well; an obliquely angled cartridge feed ramp formed by an integral unitary portion of the frame proximate to the breech area, the feed ramp comprised of the same first material and hard anodized surface as the frame; and a machined wear insert affixed to the feed ramp, the wear insert including an obliquely angled hard anodized wear surface, the wear insert formed of a second material different than the first material of the frame; wherein the hard anodized wear surface of the wear insert has a greater hardness than the hard anodized surface of the frame.

A method for fabricating a firearm frame with hardened cartridge feed ramp is provided. The method includes steps of: providing a wear insert in a pre-machined shape; implanting the wear insert in a cartridge feed ramp portion of a firearm frame; machining the wear insert in situ to a post-machined shape different than the pre-machined shape; and surface hardening the wear insert and frame together simultaneously in a single surface hardening process step.

BRIEF DESCRIPTION OF THE DRAWINGS

The features of the preferred embodiments will be described with reference to the following drawings where like elements are labeled similarly, and in which.

All drawings are schematic and not necessarily to scale. A reference herein to a figure number herein that may include multiple figures of the same number with different alphabetic suffixes shall be construed as a general reference to all those figures unless specifically noted otherwise.

DETAILED DESCRIPTION

Figure 1:
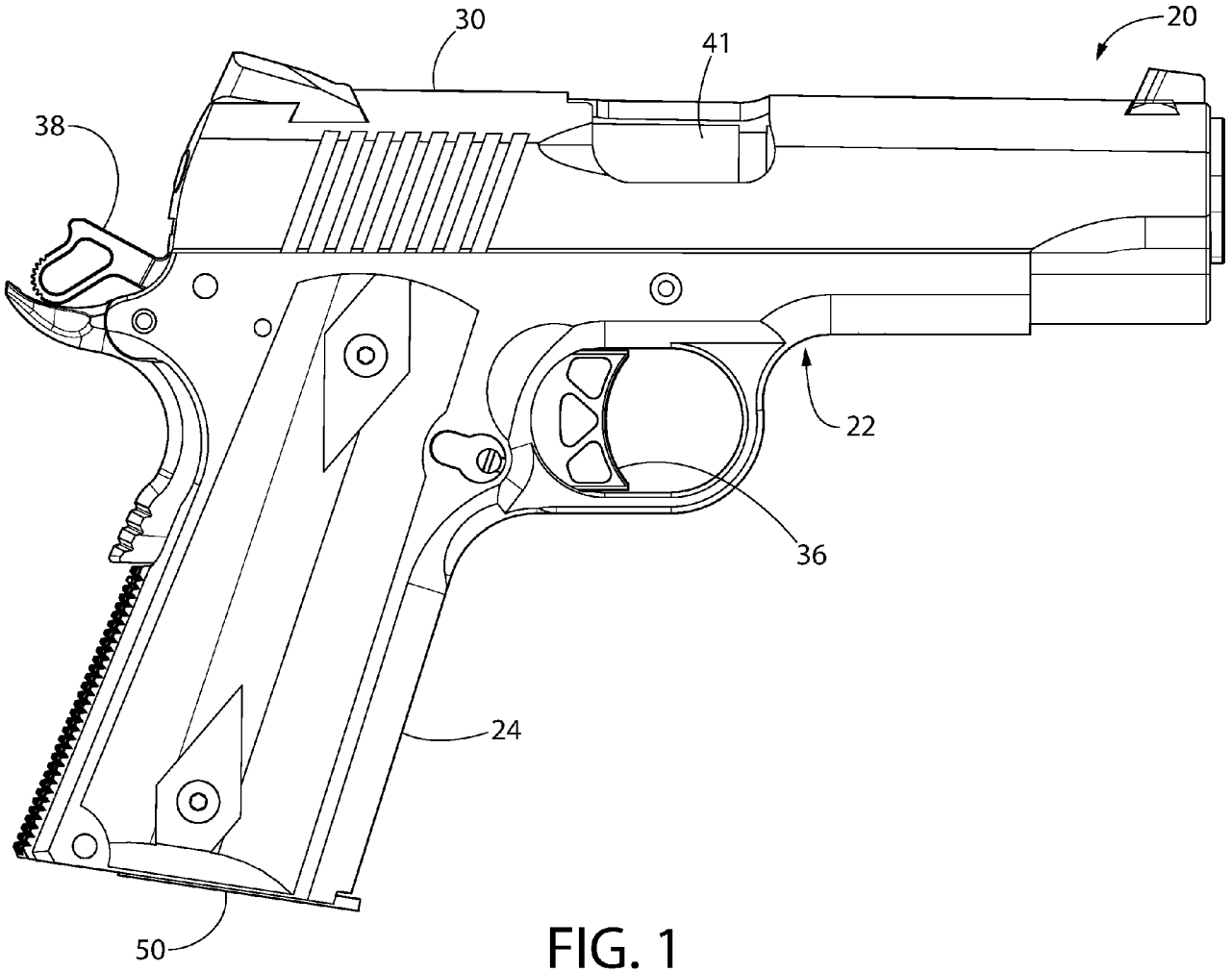
FIG. 1 is a right side elevation view of a firearm according to the present disclosure.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

Figure 2:
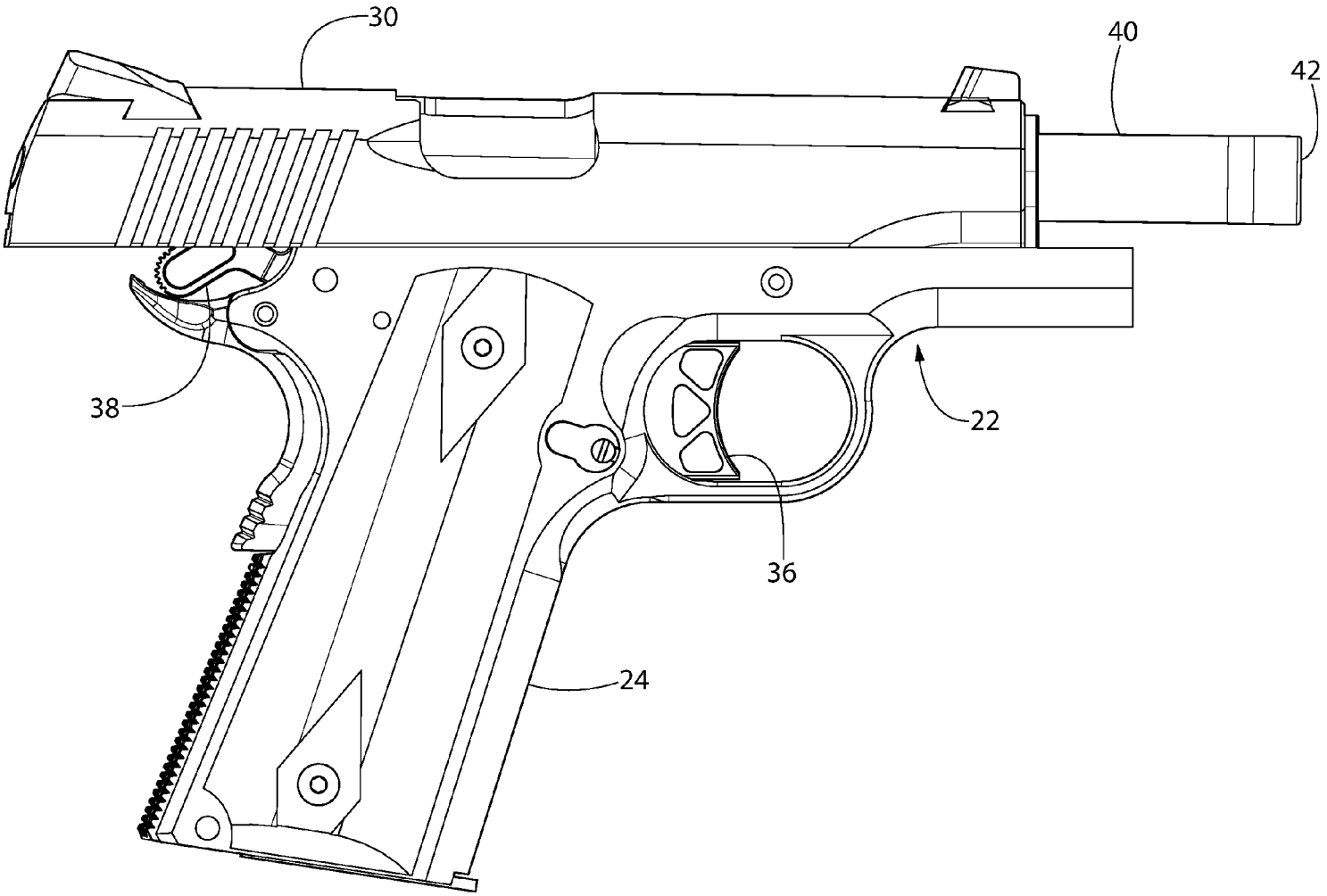
FIG. 2 is a right side elevation view thereof showing an open breech.
Figure 3A:
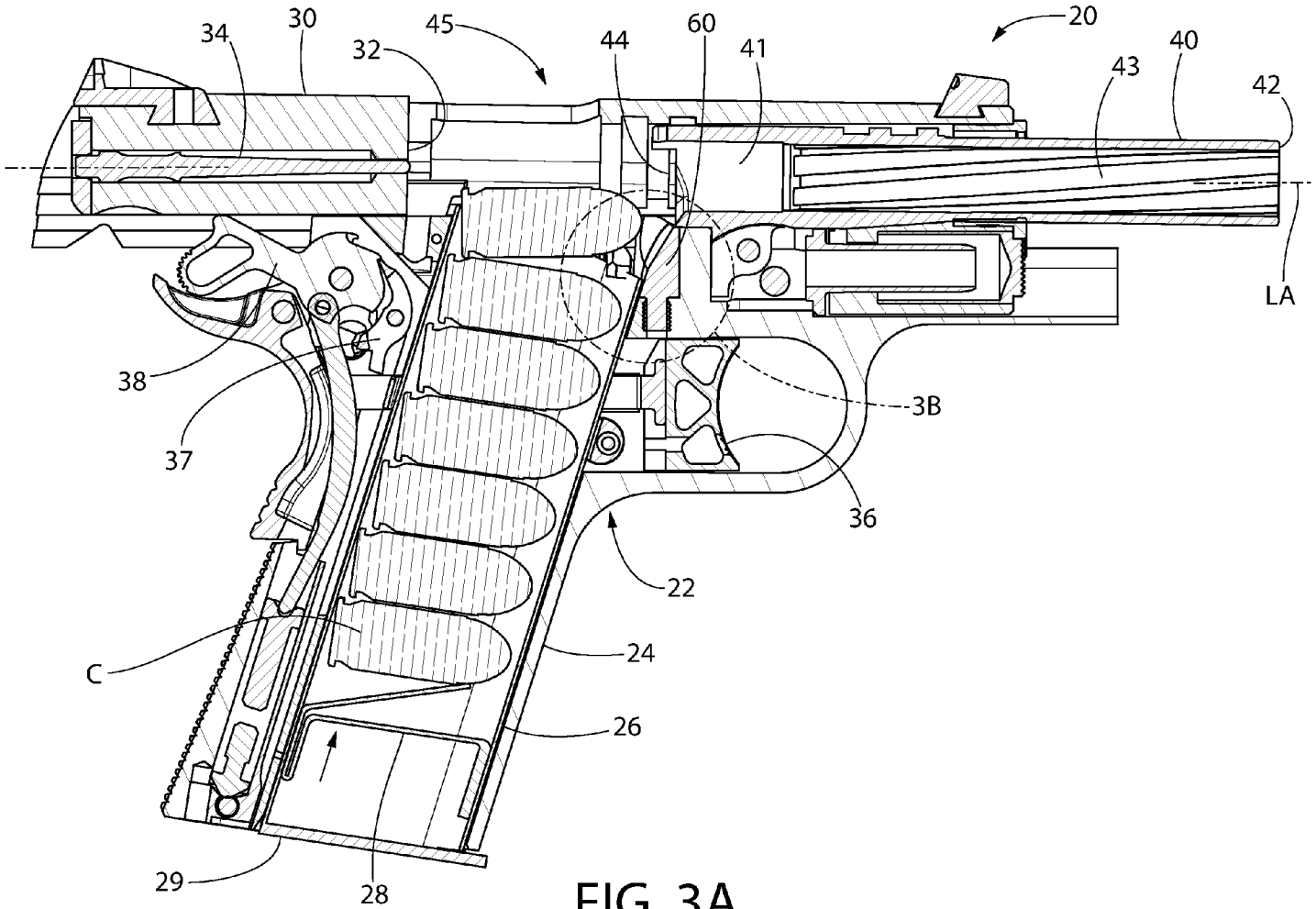
FIG. 3A is a right side cross-sectional elevation view of the firearm of FIG. 2 showing a cartridge feed ramp wear insert.
Figure 3B:
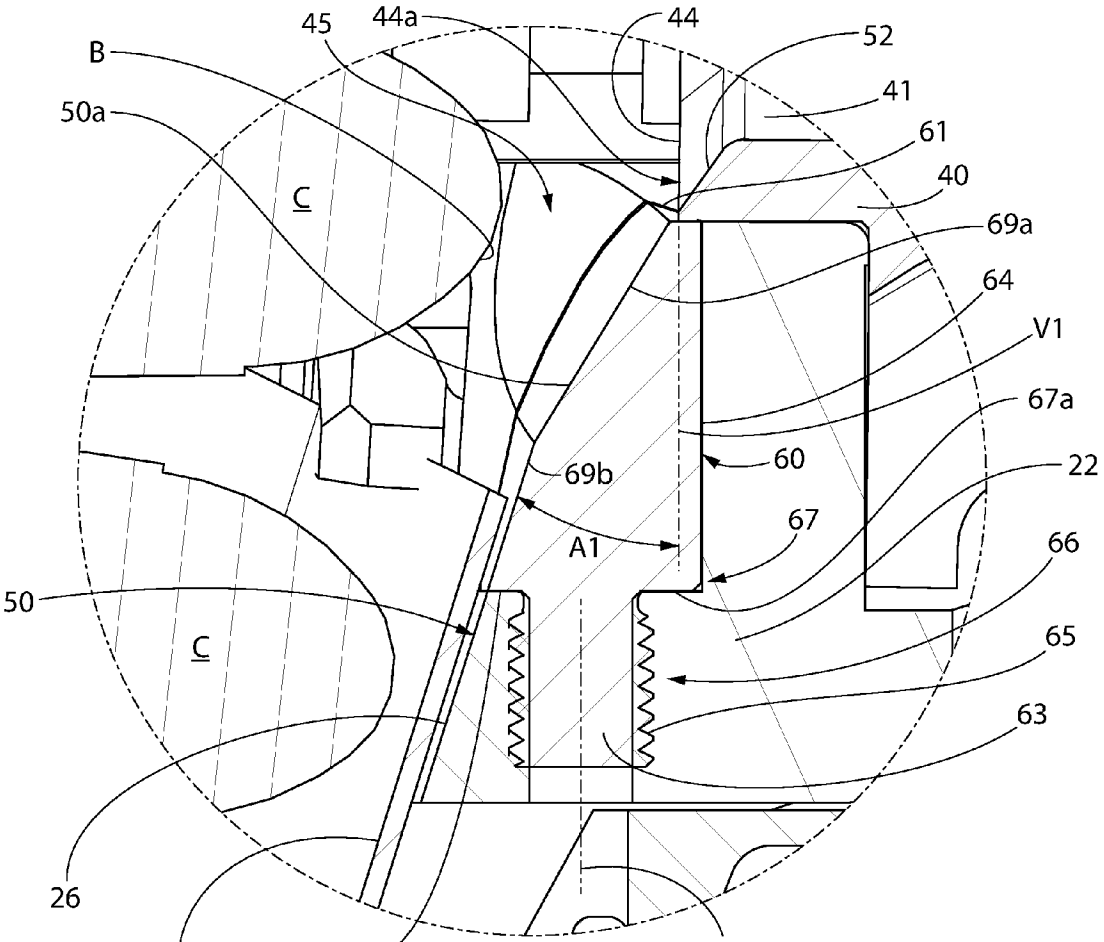
FIG. 3B is an enlarged detail of the feed ramp portion of the firearm taken from FIG. 3A.

FIGS. 1 and 2 are right side views depicting a non-limiting embodiment of a firearm in the form of a pistol 20 having a feed ramp formed in accordance with the present disclosure. FIG. 3A is a right side longitudinal cross-sectional view of the pistol. FIG. 3B is a detailed view taken from FIG. 3A. The pistol may be a 1911 model pistol as shown; however, the invention is not limited for use in this particular type of firearm and may be used with other firearms in which the feed ramp is formed by a portion of the frame.

Referring to FIGS. 1-3B, pistol 20 includes a metallic grip frame 22 supporting a slide 30 and barrel 40. The grip frame 22 may have a unitary monolithic structure comprising a body including a downwardly extending grip portion 24 configured for grasping by a user. Grip portion 24 defines a downwardly open magazine well 26 configured for mounting a removable magazine 29 therein. Magazine 29 is a generally hollow structure configured for holding a plurality of ammunition cartridges C which are automatically dispensed and uploaded into the breech area 45 of the pistol by a spring-biased follower 28 each time the action is cycled.

Grip frame 22 may be made of any suitable metal including steel, aluminum, or others. For providing a light-weight pistol, aluminum is preferred in one non-limiting embodiment.

Slide 30 may be slidably mounted on frame 22 via a conventional support rail and slide groove system or other arrangement for axial reciprocating movement forwards and rearwards thereon when cycling the action manually or under recoil after firing the pistol 20. A recoil spring (not shown) operably associated with slide 30 acts to return the slide forward to the position shown in FIG. 1 after firing. The slide 30 may be formed of any suitable metallic material such as steel, aluminum, or others.

Barrel 40 defines a longitudinal axis LA and includes a front muzzle end 42 and an opposite rear breech end 44 defining a rearwardly open chamber 41 configured for holding a cartridge C. A longitudinally extending bore 43 is defined between ends 42 and 44 which forms a pathway for a bullet B or slug. Bore 43 may be rifled in some embodiments as shown. An openable and closeable breech area 45 (or simply "breech") is defined at the rear end 44 of barrel 40 above the magazine well 26 of the frame 22 (see FIG. 3). The slide 30 includes a forward facing breech face 32 which creates a closed breech when in battery with the rear end 44 of the barrel for firing the pistol 20, or an open breech as shown in FIG. 3 for extracting/ejecting spent cartridge casings and loading fresh cartridges C into the chamber 41. The barrel 40 is preferably made of steel for strength and durability to withstand the high pressures developed by detonating a cartridge charge and increase the longevity of the barrel bore 43 which encounters the bullet or slug.

A trigger-actuated firing mechanism operates to discharge pistol 20. The firing mechanism may generally comprise a trigger 36 slideably or pivotably mounted to grip frame 22 and spring-biased pivotable hammer 38 operably connected to the trigger via a mechanical linkage including a rotatable sear 37. The hammer 38 is configured and arranged to strike a firing pin 34 slideably disposed in the slide 30. The firing pin 34 has a front tip which is projectable beyond the breech face 32 when struck by the hammer 38 to in turn strike a chambered cartridge C. Sear 37 operates to hold the hammer 38 in a rearward cocked and ready-to-fire position until the trigger is pulled. Pulling trigger 36 with a closed breech rotates the sear 37 and releases the cocked hammer 38 to strike the firing pin and discharge the pistol.

Referring now to FIGS. 3A and 3B, a rear and upward facing obliquely angled and inclined (with respect to the longitudinal axis LA) cartridge feed ramp 50 is disposed in the grip frame 22 at the upper end of the magazine well 26. The feed ramp 50 is positioned at the rear breech end 44 of barrel 40 and immediately below the breech end adjoining the open obliquely inclined and angled (with respect to longitudinal axis LA) annular entrance 52 to the chamber 41.

Feed ramp 50 defines a cartridge feed or wear surface 50*a* disposed at oblique angle A1 to a vertical plane V1 defined by the rear facing breech surface 44*a* at breech end 44 of barrel 40. The feed ramp 50 is positioned to slideably engage the slug or bullet B at the front end of cartridge C when the top-most cartridge is dispensed and loaded into chamber 41. In one embodiment, wear surface 50*a* is arcuately shaped to conform to the rounded shaped of the bullet disposed in the front of the cartridge C for smooth feed and chambering of the round.

According to one aspect of the invention, a feed ramp wear insert 60 formed of a wear resistant material is disposed on and implanted in the feed ramp 50 portion of the frame 22. In one embodiment, the wear insert 60 defines the wear surface 50*a* which is formed as an integral unitary structural portion of the insert and has a greater hardness than the feed ramp 50, as further described herein.

In one embodiment, wear insert 60 has a hardness (after surface hardening) greater than the material used to construct the grip frame 22 for improving the wear life of the feed ramp 50. For example, for a light-weight grip frame formed of aluminum, the wear insert may be made of an inherently harder metal such as some grades of steel, or alternatively and more preferably a light-weight metal having a higher density than aluminum (e.g. about 2.7 g/cm$^3$) but less than steel (e.g. about 7.8 g/cm$^3$) which is then subjected to a surface hardening processes. For example, the wear insert 60 may be made of without limitation titanium (e.g. about 4.5 g/cm$^3$ density) or another metal. Ideally, the optimum benefits may be obtained in some implementations by using the foregoing light-weight surface hardened wear insert in combination with an inherently lower hardness light-weight grip frame metal such as aluminum to produce a light-weight metal framed pistol. This achieves a lighter firearm in contrast with more durable steel framed pistols without completely sacrificing the durability and wear life of the cartridge feed ramp inherent in aluminum framed pistols with integral feed ramps that lack wear inserts. In one non-limiting embodiment, the grip frame 22 may be made of aluminum and the wear insert 60 may be made of titanium both of which are hard anodized. In another example, the wear insert and frame may both be made of hard anodized titanium. Other combinations of frame and wear insert materials may be used some of which preferably utilize a wear insert having a higher hardness and density in material properties (whether inherently or through a surface hardening process) than the frame material. In some preferred embodiments the light-weight metals (i.e. less than steel) selected for the grip frame and wear insert should both be amendable to surface hardening using the same surface hardening process, as further described herein.

In one example, without limitation, the base metal used for grip frame 22 may be made of aluminum alloy E357, Rockwell Hardness HREW 93 minimum (about 2.7 g/cm$^3$ density). The base metal used for wear insert 60 may be made of titanium 6AL-4V Grade 5, Rockwell Hardness HRC 30-34 (about 4.4 g/cm$^3$ density).

Referring now to FIGS. 3A and 3B, the feed ramp wear insert 60 is positioned so that the top end 61 of the body is positioned proximate to the rear breech end 44 of the barrel 40 and breech surface 44*a*. The rear side of the bottom end 62 of the wear insert 60 body is positioned inline and substantially flush with the feed ramp 50 to form a smooth transition into the ramp. The vertical centerline Cv of the wear insert 60 is disposed orthogonally (i.e. 90 degrees/perpendicular) to the longitudinal axis LA of the pistol 20 when installed in one non-limiting configuration. It bears noting that centerline Cv in this configuration is parallel to the vertical plane V1 defined by the rear facing breech surface 44*a* at breech end 44 of barrel 40 when the wear insert 60 is mounted in the frame 22 (see, e.g. FIG. 3B). In other possible arrangements, the wear insert 60 and its centerline Cv may be disposed at an oblique angle to the longitudinal axis LA.

According to another aspect of the invention, the feed ramp wear insert 60 is both machined and surface hardened in situ in the frame 22 after mounting on the feed ramp 50, as further described herein. FIGS. 4 and 6 and FIGS. 5 and 7 show the wear insert before machining (i.e. pre-machined shape) and after machining (i.e. post-machined shape), respectively. In the pre-machined shape, the wear insert 60 has a vertically elongated main cylindrical body 64 (when viewed in the "as installed" position in FIG. 3) that defines the vertical centerline Cv, top end 61 of the body, and bottom end 62 of the body discussed above. The body 64 has a full cylindrical shape before machining with a full diameter and circumferentially extending arcuate sides extending a full 360 degrees. In one embodiment, a mounting stem 63 extends downward from the body 64 and is configured for coupling to the feed ramp 50 portion of the grip frame 22. In one configuration, the mounting stem 63 is externally threaded 65 to engage an upwardly open complementary configured internally threaded socket 66 formed in the grip frame 22 (see, e.g. FIGS. 3A-B). Mounting stem 63 is concentrically aligned with the vertical centerline Cv. In one embodiment, the stem 63 may have a reduced diameter smaller than the diameter of the main cylindrical body 64 of the wear insert. At the site where the wear insert 60 is to be mounted, the grip frame 22 may have a shoulder 67 forming a horizontal surface 67*a* which serves as a seat and limit stop for installing the wear insert 60 to the proper depth in the feed ramp 50. In other possible embodiments contemplated, the stem 63 may be unthreaded and secured in an unthreaded socket 66 via methods such as a shrink-fitting, frictional fit, or adhesives. In yet other embodiments, the mounting stem 63 may be omitted and the bottom end 62 of the wear insert 60 either with or without threads may be sized for insertion into the upwardly open socket 66 of frame 22.

Figure 6:
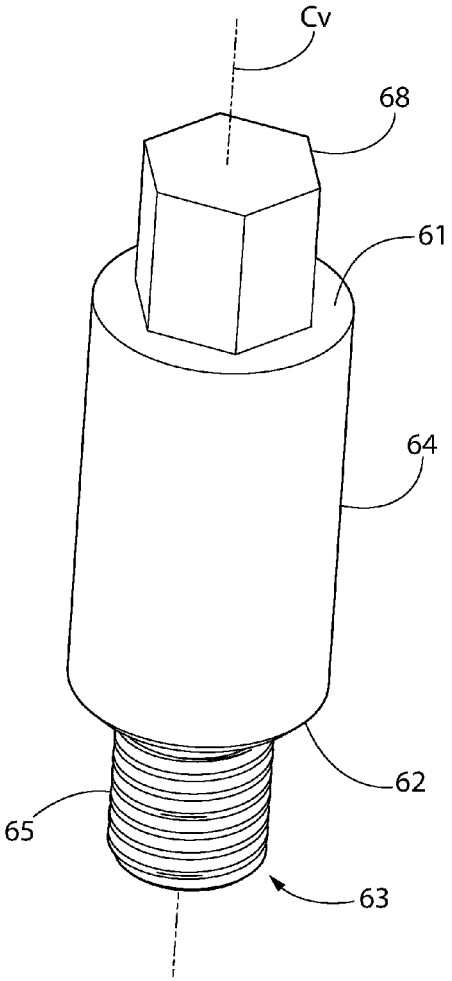
FIG. 6 is a perspective view of wear insert before machining and disembodied from the firearm.

A tool engagement feature 68 may be provided at the top end 61 of the wear insert body 64 to facilitate mounting the insert in the frame 22. In one embodiment, the tool engagement feature 68 may be a protrusion extending upwards from the body 64 as shown in FIG. 6. The tool engagement feature 68 may have any configuration which complements the configuration of the tool intended to be used for rotating and threadably mounting the wear insert 60 in the frame. In the non-limiting example illustrated, the tool engagement feature has a hex shape to engage a hex shaped wrench or socket. Other shapes however may be used and does not limit the invention. In yet other embodiments, a hex or other shaped socket may instead be provided which engages a complementary configured tool end (e.g. hex or square wrench, etc.). The invention is not limited to the shape of the tool engagement feature so long as the wear insert 60 may be rotated to threadably engage the mounting stem 63 with the frame socket 66.

A process or method for fabricating a firearm frame with hardened cartridge feed ramp will now be briefly described using the wear insert 60 described above. The process begins by providing wear insert 60 in the pre-machined condition (see, e.g. FIG. 6). The wear insert it then positioned and oriented vertically over the feed ramp 50 portion of the frame 22. The mounting stem 63 of the insert is then inserted into upwardly open socket 66 and rotated with a tool via the tool engagement feature 68 described above to rotatably and threadably engage the wear insert 60 with the frame 22. The wear insert 60 has now been mounted or implanted in the frame. At this point in the installation process, the frame and insert appear as shown in FIG. 4 before machining of the insert or surface hardening of the frame and insert.

Figure 4:
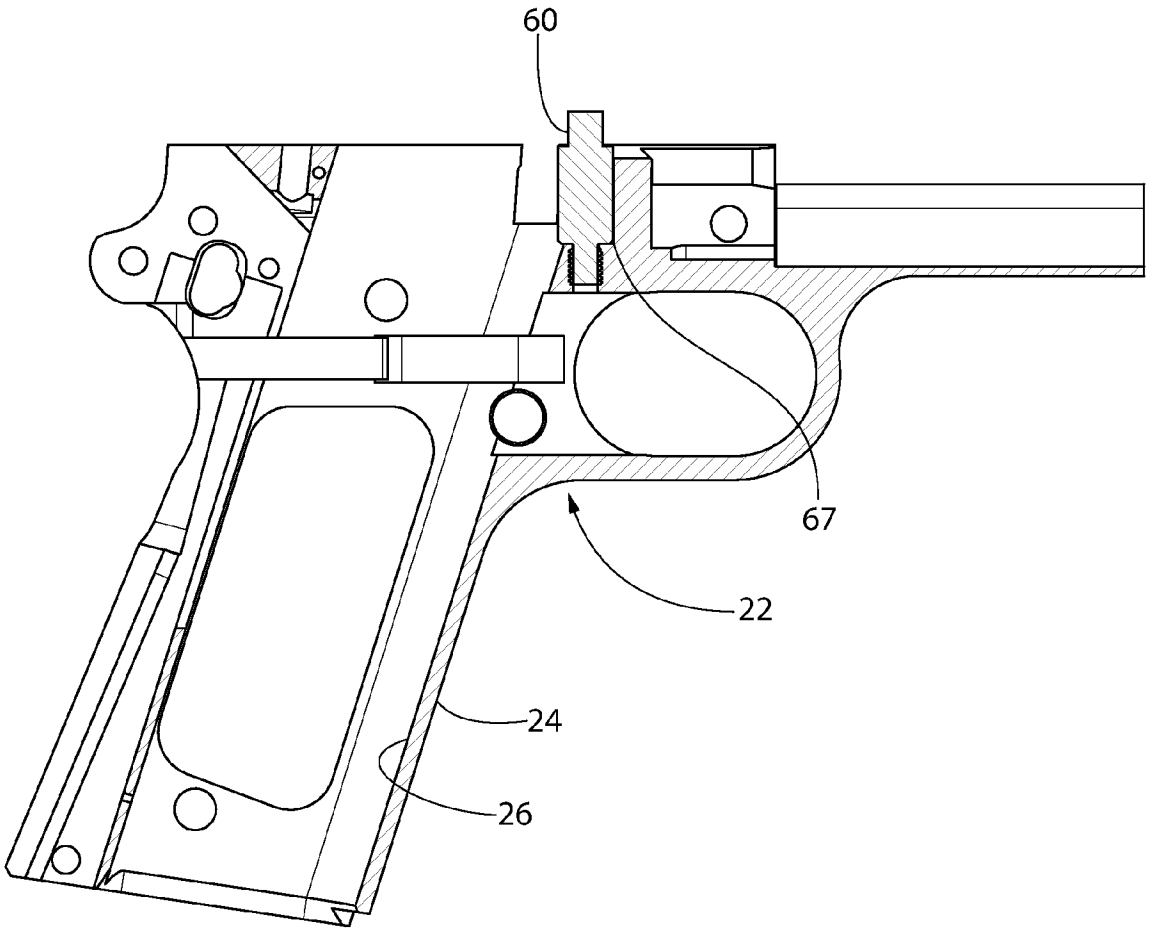
FIG. 4 is a right side cross-sectional elevation view of the firearm frame with feed ramp wear insert in place before machining.
Figure 7:
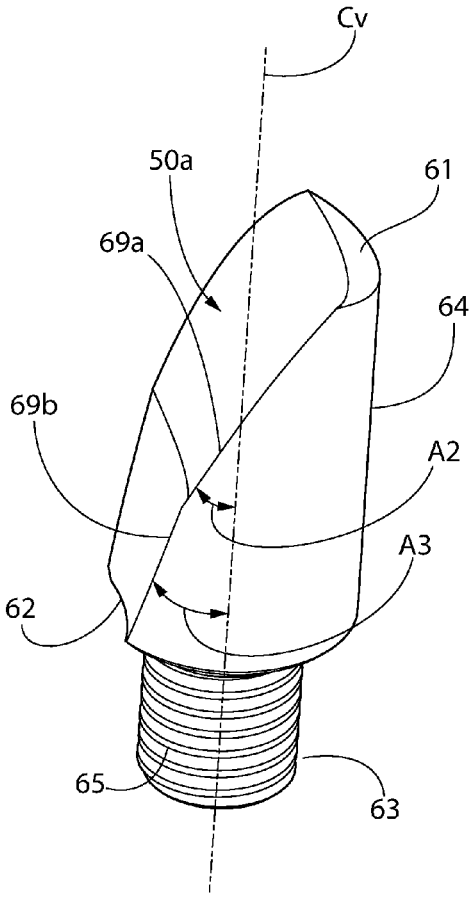
FIG. 7 is perspective view of the wear insert after machining and disembodied from the firearm.

After the wear insert 60 is mounted or implanted in the grip frame 22 as shown in FIGS. 3A-B and 4, the wear insert is next machined in situ or place to a shape having a rear face that closely matches the inclined angle and shape of the feed ramp 50 of the pistol grip frame 22 (see also FIG. 7). Any suitable milling or other tool may be used to shape the wear insert. Preferably, the wear insert 60 may be machined to form an arcuately shaped concave wear surface 50*a* to approximate and complement the rounded shape of the cartridge case and bullet B for smooth feeding of cartridge C into the chamber 41. In one embodiment, the wear insert 60 may be machined to have a compound angled wear surface 50*a* comprising an upper angled surface portion 69*a* obliquely disposed at an angle A2 to vertical centerline Cv of the insert and a continuous adjoining lower angled surface portion 69*b* obliquely disposed at an angle A3 to vertical centerline Cv (see FIG. 3B). In one embodiment, angle A2 is larger than A3 which is more vertical and steeper. Angles A2 and A3 are preferably between 0 and 90 degrees, for example between 30 and 70 degrees in some configurations. In one embodiment, angle A3 of the lower angled surface portion 69*b* may be substantially equal to angle A1 of the feed ramp 50 of the frame while angle A2 of the upper angled surface portion 69*a* is different and larger than angles A1 and A3. In certain other embodiments, wear surface 50*a* may have one continuous slope represented by a single angle A1 corresponding to the feed ramp 50 in the drawings in lieu of two differently angled surface portions 69*a*, 69*b*. The front face of the wear insert 60 opposite the machine wear surface 50*a* retains its partial cylindrical arcuately convex shape.

Figure 5:
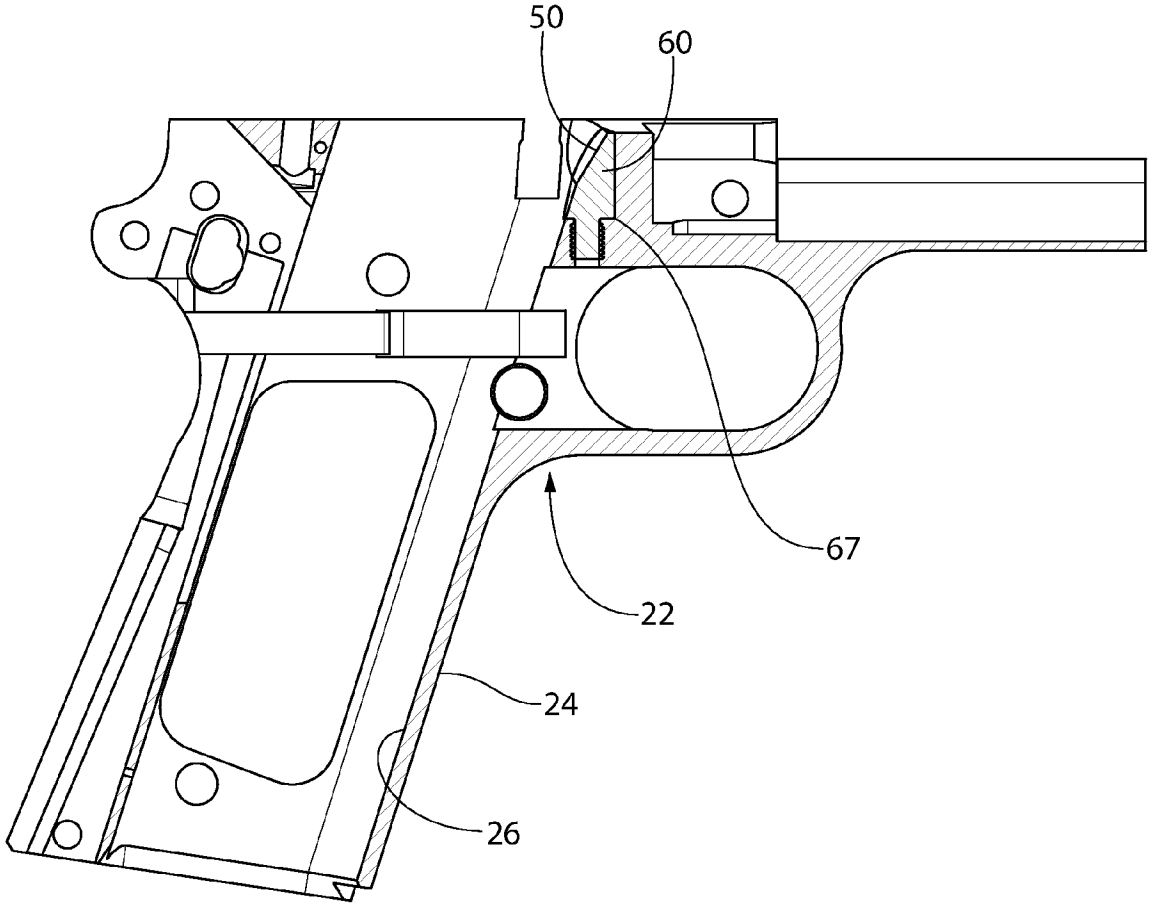
FIG. 5 is a right side cross-sectional elevation view of the firearm frame with feed ramp wear insert in place after machining.

FIGS. 5 and 7 illustrate the post-machined shape or configuration of the wear insert. It bears noting that the tool engagement feature 68 has been completely removed during the machining step since it has served its initial purpose for mounting the wear insert 60 to the grip frame 22. The wear insert 60 now has a partial cylindrical shape with arcuate sides on the front and the obliquely angled concave wear surface 50*a* on the rear.

Following the machining operation on the wear insert 60 in the grip frame 22, the final step in the fabrication process is to surface harden the wear insert in situ or place. In one embodiment, the grip frame and wear insert may preferably be surface hardened together simultaneously in a single process step. For example, the wear insert 60 may be made of titanium and frame 22 may be made of aluminum in a certain embodiment as described above. Both the wear insert and frame may be hard anodized together in one process step for efficiency, thereby saving fabrication costs in contrast to surface hardening each component separately. The anodization process increases the surface hardness of the titanium wear insert down to a depth to withstand repeated loading cycles of feed cartridges C into the barrel chamber 41 of the pistol 20. The surface hardened titanium wear insert is significantly more wear resistant and durable than the softer original integral feed ramp of the aluminum frame even when hard anodized. Anodized aluminum surfaces are harder than the base metal, but only have generally low to moderate wear resistance characteristics. By contrast, the anodized titanium wear insert 60 has a higher surface hardness than the surface hardness of the anodized aluminum frame.

As a non-limiting example, representative surface hardnesses encountered for metals that may be used to form a firearm frame include: untreated Aluminum Alloy 6082=HV 100-120; Hard Anodized Alloy 6082=HV 400-460; Stainless Steel=HV 300-350; and Mild Steel=HV 200-220, wherein HV=Vickers hardness scale. The hard anodized titanium wear insert 60 has a greater surface hardness than hard anodized aluminum.

In one non-limiting example, a Type III, Class 2 Hard Anodize (black hardcoat anodizing) sulfuric acid based electrolytic passivation process (MIL-A-8625 and AMS 2469 standards) may be used to produce a suitable hardened oxide surface layer for increased wear resistance of the exposed wear surface 50*a* of wear insert 60 and the entire aluminum grip frame 22. Type III hard anodize process produces a harder, more wear resistant oxide film of greater thickness than the standard anodizing processes (e.g. Types I or II). In other possible embodiments contemplated, a Type III, Class 1 Hard Anodize process may be used. Representative thicknesses of the oxide films formed on the surface of the titanium wear insert and aluminum frame formed by a Type III hard anodize process may preferably be greater than 1 mil (0.001"=0.026 mm), and in certain preferred embodiments without limitation about 2 mil (0.002"=0.051 mm).

The present invention advantageously provides a factory-made original equipment manufacturers (OEM) solution for a light-weight feed ramp wear insert and aluminum frame assembly having superior wear resistance than an integral aluminum feed ramp. Accordingly, heavy steel pistol frames with integral feed ramps or heavier steel wear inserts (e.g. unhardened carbon steel or stainless steel) sometimes added by gunsmiths to repair damaged aluminum frame feed ramps may be avoided by the present invention while achieving the benefit of improved feed ramp wear life.

The process of hard anodizing metals (i.e. "hardcoat" or Type III anodization) such as aluminum and titanium to form a hardened surface coat or film is well known in the art without undue elaboration. Anodization is an electrochemical process that changes the microscopic crystal structure of the metal only near the surface (not throughout the core of the metal component), thereby forming a porous oxide layer of hardened material having greater hardness and wear resistance than the original base metal. An acidic bath (e.g. sulfuric acid) and electric current are used to form the hardened oxide surface layer or film. Any suitable anodizing process, parameters, and equipment may be used to achieve the desired oxide film thickness and hardness specifications. It bears noting that the hard oxide surface film has a greater hardness than the unhardened core of the part which is anodized. Furthermore, in other embodiments contemplated, other methods for producing a hardened surface layer on the wear insert and grip frame base metals may alternatively be used.

Figure 8:
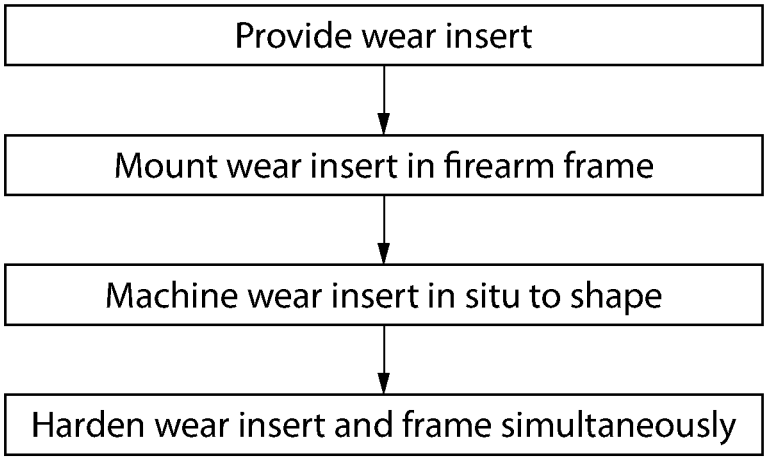
FIG. 8 is a flow chart showing steps in a process for fabricating the foregoing cartridge feed ramp in situ in the firearm frame.

FIG. 8 is a flow chart summarizing the foregoing major process steps for mounting and forming a hardened cartridge feed ramp wear insert 60 in situ for a light-weight framed firearm.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A light-weight firearm with wear resistant cartridge feed ramp comprising:

a metallic frame defining a magazine well for insertably receiving an ammunition magazine;

a barrel supported by the frame, the barrel including a longitudinally extending bore defining a longitudinal axis, a front muzzle end, and a rear breech end defining a rearwardly open chamber configured for holding a cartridge;

an obliquely angled cartridge feed ramp formed by an integral unitary portion of the frame, the feed ramp disposed at an upper end of the magazine well near the rear breech end of the barrel and made of a same material as the frame;

a surface hardened wear insert affixed to the feed ramp adjacent to the chamber in the rear breech end of the barrel, the wear insert arranged to engage a cartridge being loaded into the chamber from the magazine;

wherein the wear insert is formed of a different material than the feed ramp;

wherein the wear insert includes an obliquely angled wear surface having a greater hardness than a surface of feed ramp of the frame;

wherein the wear insert has an elongated cylindrical body oriented vertically in the frame and the wear surface is formed on a rear face of the body adjoining the feed ramp of the frame; and wherein the wear insert includes a top end positioned proximate to an annular rear entrance to the chamber and a bottom end including a downwardly extending mounting stem received in an upwardly open socket of the frame.

2. The firearm according to claim 1, wherein the wear insert is formed of a material having a density greater than the frame but less than the density of steel.

3. The firearm according to claim 2, wherein the wear insert is made of hard anodized titanium and the frame including the feed ramp is made of hard anodized aluminum.

4. The firearm according to claim 1, wherein the frame includes a shoulder forming a horizontal surface on which the bottom end of the wear insert is abuttingly seated, the upwardly pen socket of the frame being formed in the horizontal surface.

5. The firearm according to claim 1, wherein the mounting stem and socket are threaded to rotatably couple the wear insert to the feed ramp.

6. The firearm according to claim 1, wherein the wear surface is arcuately concave in shape to conform to the shape of a front end of the cartridge.

7. The firearm according to claim 1, wherein the firearm is a pistol.

8. The firearm according to claim 1, wherein the wear surface has a compound angled configuration comprising an upper angled surface portion obliquely disposed at a first angle to a vertical centerline of the wear insert and a continuous adjoining lower angled surface portion obliquely disposed at a second angle to the vertical centerline, the first angle being different than the second angle.

9. A light-weight frame with wear resistant cartridge feed assembly for a firearm, the frame comprising:

a longitudinal axis;

a metallic body having an unitary monolithic structure formed of a first material and a hard anodized surface;

a downwardly open magazine well configured for removably receiving an ammunition magazine;

a breech area defined at a top of the magazine well;

an obliquely angled cartridge feed ramp formed by an integral unitary portion of the frame proximate to the breech area, the feed ramp comprised of the same first material and hard anodized surface as the frame;

a machined wear insert affixed to the feed ramp, the wear insert including an obliquely angled hard anodized wear surface, the wear insert formed of a second material different than the first material of the frame;

wherein the hard anodized wear surface of the wear insert has a greater hardness than the hard anodized surface of the frame;

wherein the wear insert has an elongated cylindrical body oriented vertically in the frame and the obliquely angled wear surface is disposed on a rear facing side of the body adjoining the feed ramp of the frame; and wherein the wear insert includes a top end positioned proximate to an annular rear entrance to the chamber and a bottom end including a downwardly extending mounting stem received in an upwardly open socket of the frame.

10. The frame according to claim 9, wherein the wear insert is formed of a material having a density greater than the frame but less than the density of steel.

11. The frame according to claim 10, wherein the wear insert is made of hard anodized titanium and the frame including the feed ramp is made of hard anodized aluminum.

12. The frame according to claim 9, wherein the frame includes a shoulder forming a horizontal surface on which the bottom end of the wear insert is abuttingly seated, the upwardly open socket of the frame being formed in the horizontal surface.

13. A method for fabricating a firearm frame with hardened cartridge feed ramp, the method comprising:

providing a wear insert in a pre-machined shape;

implanting the wear insert in a cartridge feed ramp portion of a firearm frame;

machining the wear insert in situ to a post-machined shape different than the pre-machined shape; and surface hardening the wear insert and frame together simultaneously in a single surface hardening process step.

14. The method according to claim 13, wherein the surface hardening process step is performed by hard anodization.

15. The method according to claim 13, wherein the wear insert is made of hard anodized titanium and the frame is made of hard anodized aluminum.

16. The method according to claim 13, wherein the wear insert in the pre-machined shape comprises a vertically elongated full cylindrical body including a top end having a tool engagement feature and a bottom end having a mounting feature.

17. The method according to claim 16, wherein the implanting step includes vertically inserting the mounting feature in an upwardly open socket formed in the feed ramp portion of the frame.

18. The method according to claim 17, wherein the implanting step further includes threadably engaging threads of the mounting feature with mating threads of the socket.

19. The method according to claim 18, wherein the implanting step further includes engaging the tool engagement feature with a tool, and rotating the wear insert with the tool to threadably engage the mounting feature with the socket.

20. The method according to claim 19, wherein the tool engagement feature and the tool are hex shaped.

21. The method according to claim 16, wherein the wear insert in the post-machined shape comprises a part cylindrical body and an obliquely angled wear surface on a rear face of the wear insert.

22. The method according to claim 16, wherein the machining step completely removes the tool engagement feature.

23. The method according to claim 13, wherein the wear insert is formed of a material having a density greater than the frame but less than the density of steel.

* * * * *